United States Patent [19]

Ueda

[11] Patent Number: 5,053,741

[45] Date of Patent: Oct. 1, 1991

[54] VARIABLE RESISTOR

[75] Inventor: Yukinori Ueda, Nagaokakyo, Japan

[73] Assignee: Murata Manufacturing Co., Ltd., Kyoto, Japan

[21] Appl. No.: 530,170

[22] Filed: May 29, 1990

[30] Foreign Application Priority Data

May 29, 1989 [JP] Japan ..... 1-137047

[51] Int. Cl.[5] ..... H01C 10/30

[52] U.S. Cl. ..... 338/160; 338/162; 338/164

[58] Field of Search ..... 338/159, 160, 162, 163, 338/164, 170, 172, 174

[56] References Cited

U.S. PATENT DOCUMENTS 3,631,371 12/1971 Maurice ..... 338/164
4,114,131 9/1978 Nakatsu et al. ..... 338/162
4,210,896 7/1980 Van Benthuysen ..... 338/159
4,835,511 5/1989 Henmi ..... 338/174
4,914,417 4/1990 Matsui et al. ..... 338/174

*Primary Examiner*—Marvin M. Lateef
*Attorney, Agent, or Firm*—Wenderoth, Lind & Ponack

[57] ABSTRACT

A variable resistor of the type having a substantially curved resistor provided on a substrate has an arm portion of a sliding member contacting therewith, the sliding member being rotatable, with a central portion of the resistor as a supporting point, for adjusting the resistance value by rotating the sliding member with a driver. A driver plate of the sliding member is formed substantially into a cone in shape, in which cone a driver groove portion is provided. The driver tip is guided by the conic portion and inserted into the driver groove portion.

6 Claims, 5 Drawing Sheets

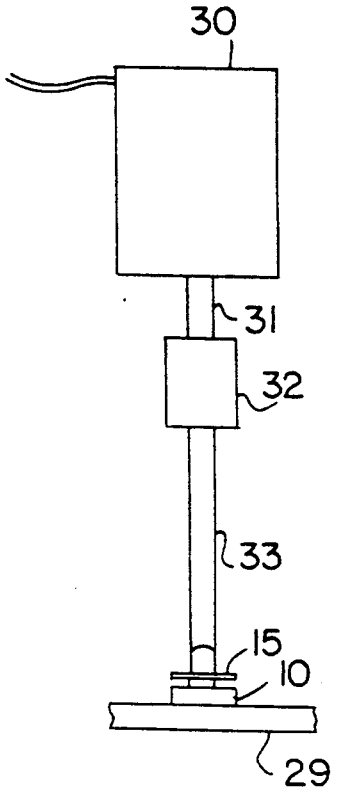
FIG. 3
FIG. 4
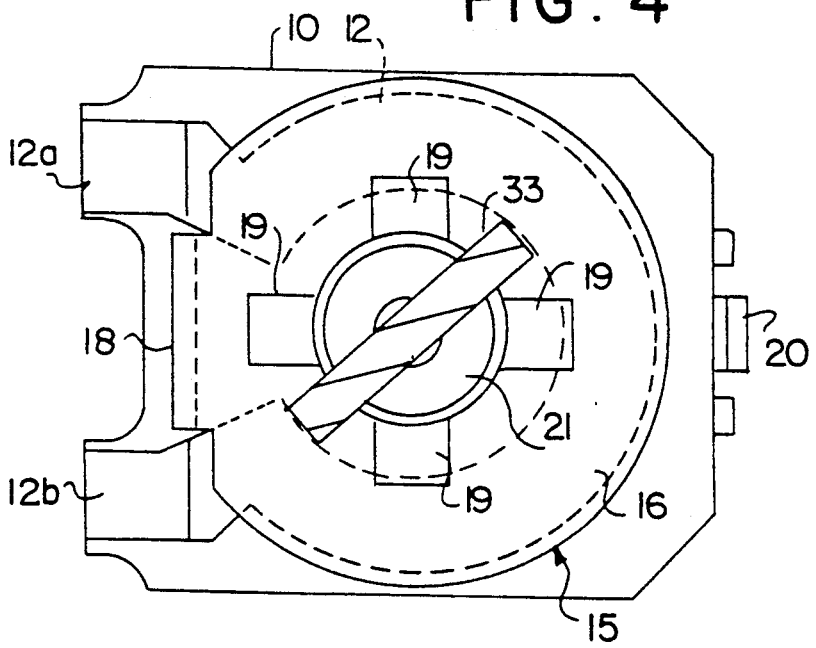

VARIABLE RESISTOR

BACKGROUND OF THE INVENTION (1) Field of the Invention

The present invention relates to a variable resistor, in particular to the construction of a sliding member incorporated in a chip-type semifixed variable resistor capable of facilitating adjustment of a resistance value by a driver.

(2) State of the Prior Art

FIGS. 8 through 10 show a conventionally well-known chip-type semifixed variable resistor.

In this variable resistor, a resistor 2 of a substantially circular arc shape is provided on a substrate 1, and a tubular portion 8*a* of a collector terminal 8 at a central hole 1*a* of the substrate 1 is caulked to rotatably fix a sliding member 3.

The sliding member 3 has a contact portion 4*a* on an arm portion 4 formed in the shape of a circular arc, some part of the circumference thereof being in contact with the resistor 2. A driver groove portion 5 is provided to enable a driver for slot-headed screws (shapes corresponding to a Phillips head driver are also available) to adjust the resistance value. Reference numerals 2*a* designate the external electrode connected respectively to both ends of the resistor 2.

In the semifixed variable resistor with the above-described construction, the driver groove portion 5 of the sliding member 3 is approximately 0.5~0.6 mm in width (W), 2.2~2.6 mm in length (L) and the gap between the driver groove portion 5 and adjusting driver approximately 0.1.

SUMMARY OF THE INVENTION

Problem to be Solved by the Invention

When manually adjusting the resistance value in the above prior art device, the driver tip can not be easily inserted into the groove portion 5, thus requiring a lot of time for the adjusting operation and causing lower work efficiency.

On the other hand, in case where an automatic adjusting device is used, an image recognition device is required in order to detect beforehand the position of the driver groove portion 5 for the driver tip to be moved for insertion into the groove portion 5, thereby causing the cost of equipment to become higher. Yet, even with this automatic way of adjustment, the insertion probability of the driver has not been as high as expected, thus leaving unsolved reliability problems in automatic adjustment.

Accordingly, to solve the problems, it is an object of the present invention to provide a variable resistor equipped with a sliding member superior in driver tip insertion and capable of adjusting the resistance value with ease and certainty.

Measures for Solving the Problems

In order to solve such problem as described above, the present invention has adopted a construction having a sliding member wherein out of a sheet of conductive thin plate are stamped out, under a connected condition, a driver plate having at the center thereof a substantially plate-like projected portion and a substantially ring-shaped arm portion having a contact portion. The driver plate is substantially conically formed, in which the driver groove portion is provided, and the driver plate and arm portion are bent over upon themselves at connecting portion by 180° to project the projected portion from the arm portion.

Operation

In the construction as described above, the sliding member is rotatably retained on the substrate by the plate-shaped projected portion of the driver plate, and the driver plate is positioned outside the arm portion to thereby not only remove the fear of deformation of the arm portion caused by external force, but also ensure that a driver tip for adjusting is guided by the conic shaped portion into the driver groove portion, due to the groove portion being substantially conic in shape.

BRIEF DESCRIPTION OF THE DRAWINGS

FIG. 3 is a schematic diagram of automatic adjustment, FIG. 4 is a plan view showing the condition under which a driver is applied to a sliding member.

DETAILED DESCRIPTION OF THE PREFERRED EMBODIMENTS

Figure 1:
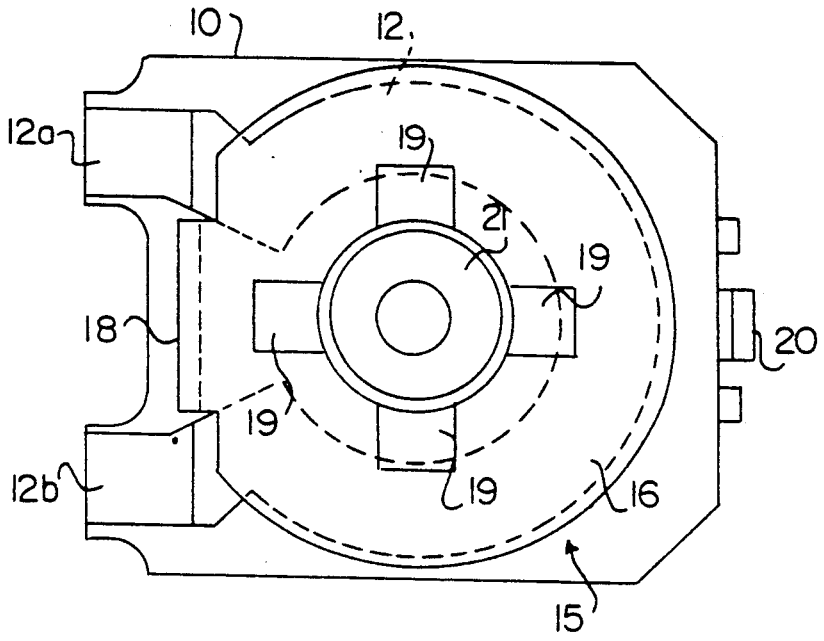
FIG. 1 is a plan view showing a first example of a variable resistor according to the present invention.
Figure 2:
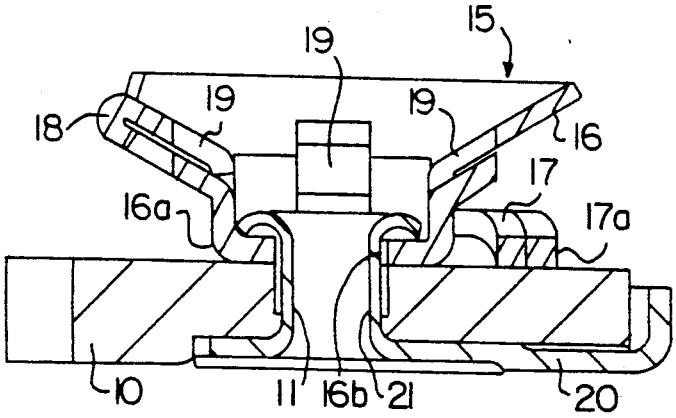
FIG. 2 is a vertical sectional view along the center of FIG. 1.

In the first example shown in FIGS. 1 through 5, a variable resistor is constructed of a substrate 10 having a resistor 12, a sliding member 15, a collector terminal 20 and resistor electrodes 12*a* and 12*b*.

The resistor 12 is mounted on the substrate 10 substantially in the shape of a circular arc with a hole 11 r as its center. In addition, the resistor 12 is connected at both ends thereof to the resistor electrodes 12*a* and 12*b* formed from the side of the reverse of the substrate 10.

The sliding member 15 is constructed in such a way that a driver plate portion 16 and an arm portion 17 are bent over upon themselves to lap. In other words, the sliding member 15 is obtained from a sheet of conductive thin plate, stamped out under the conditions such that the driver plate portion 16 having at the center thereof a substantially plate-like projected portion 16*a* and the substantially ring-shaped arm portion 17 having a projected contacted portion 17*a* are connected and then bent over upon themselves by 180° at the connecting portion 18, the projected portion 16*a* projecting downward from the arm portion 17. The driver plate portion 16 is designed to have an outer diameter a little larger than that of the arm portion 17 and to be conic in shape, on the inclined plane of which is formed a Phillips-type driver groove portion 19.

The sliding member 15 constructed as above has a tubular portion 21 of the collector terminal 20 passing through the hole 11 of the substrate 10, engaging the hole 16*b* of the projected portion 16*a* and caulked so that it is rotatably retained on the substrate 10 concentrically with the resistor 12. In this case, the contact portion 17*a* is brought into contact with the resistor 12 by desirable spring force of not only the arm portion 17 but also the connecting portion 18 and the like.

Figure 5:
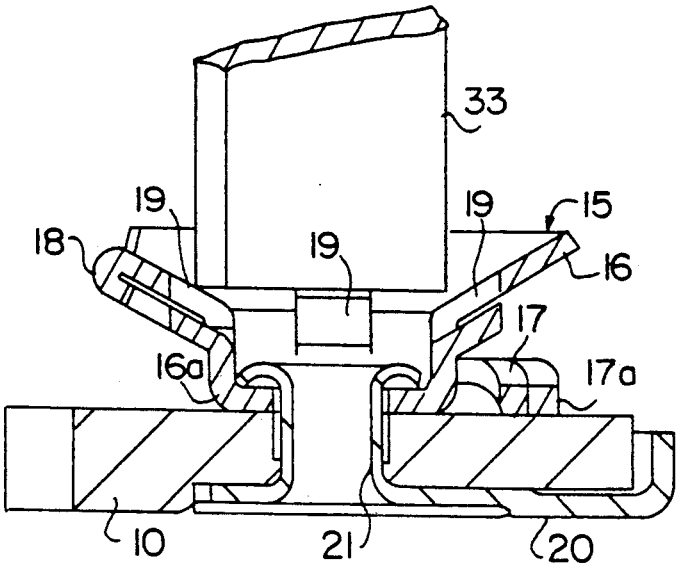
FIG. 5 is a vertical sectional view along the center of FIG. 4.

In automatically adjusting the resistance value, a driver 33 fixed through a flexible joint 32 to an output shaft 31 of a motor 30 shown in FIG. 3 is inserted from above into the groove portion 19 of the sliding member 15 to rotate the member 15 to any angle. Reference numeral 29 designates a printed wiring substrate. On this occasion, even when the tip of the driver 33 abuts against the driver groove portion 19 in a shifted manner, as shown in FIG. 4 and FIG. 5, it can be surely inserted, by rotating the driver 33 in the driver groove portion 19, rotating in the conic area without coming off of the plate portion !6.

Accordingly, the position of the driver groove portion 19 need only be roughly detected, thus doing without any such image recognition devices as a CCD camera and the like required for precise detection. Needless to say, the use of an image recognition device ensures greatly the sure insertion of the driver 33.

Figure 6:
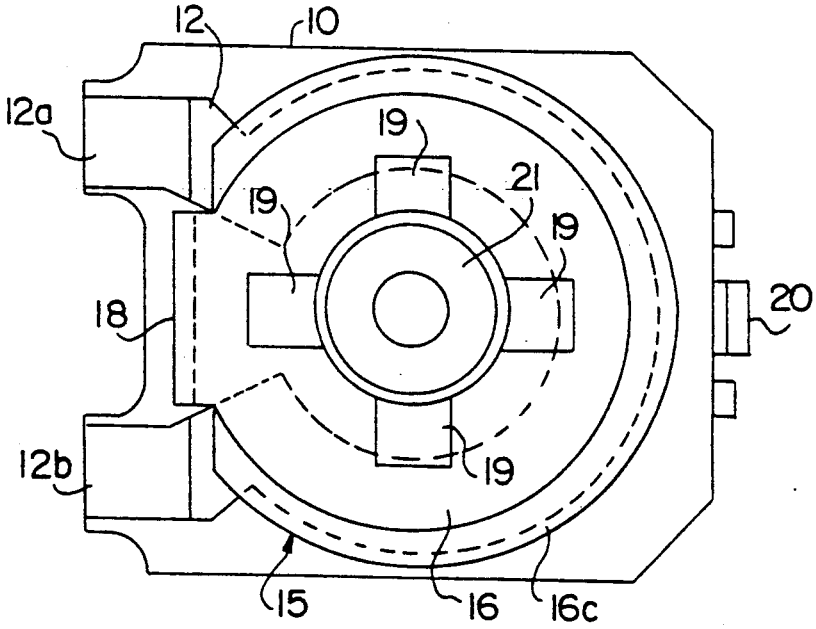
FIG. 6 is a plan view showing a second example of the variable resistor according to the present invention.
Figure 7:
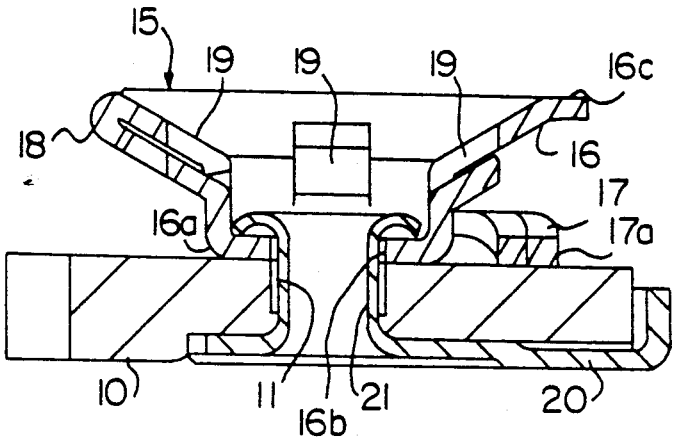
FIG. 7 is a vertical sectional view along the center of FIG. 6.
Figure 8:
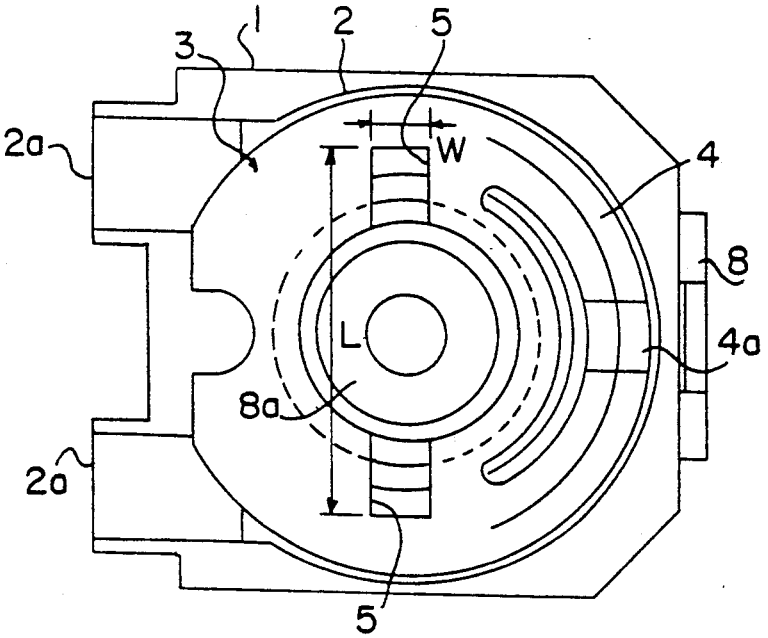
FIG. 8 PRIOR ART
FIG. 8 is a plan view showing a conventional variable resistor.
Figure 9:
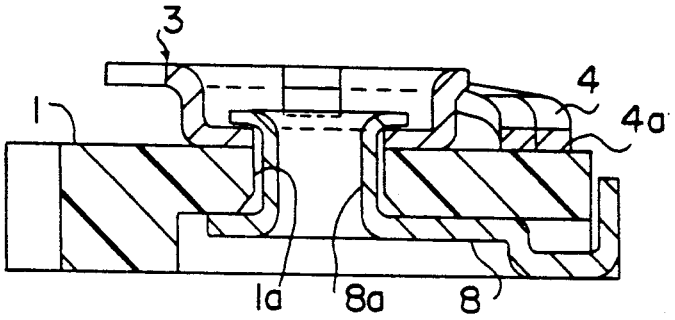
FIG. 9 PRIOR ART
FIG. 9 is a vertical sectional view along the center of FIG. 8.
Figure 10:
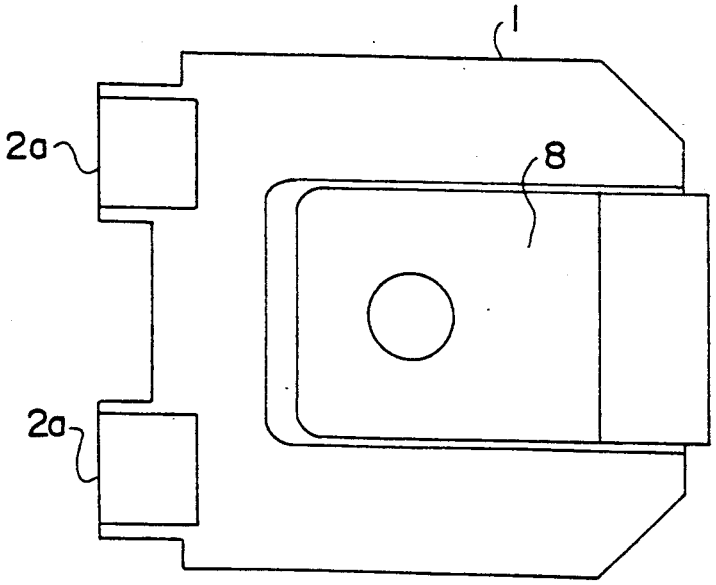
FIG. 10 PRIOR ART
FIG. 10 is a bottom plan view of FIG. 8.

Even when adjusted manually, insertion work can be conducted in a satisfactory manner, as in the case of automatic adjustment, enabling the operation time to be remarkably reduced. Next, the variable resistor in the second example shown in FIGS. 6 and 7 is explained.

In this variable resistor, the driver plate portion 16 of the sliding member 15 is made flat in shape (flat portion 16*c*) at the outer periphery thereof. The result is that the driver 33 can now be surely and easily inserted, and at the same time the contact effect with a sucking nozzle is also improved by the flat portion 16*c* when the variable resistor is conveyed onto a substrate by means of a sucking nozzle of a chip placer.

The same members as those in the above-described first example are designated by the same reference numerals and omitted of explanation.

The variable resistor according to the present invention is not limited to the examples described above, but can be modified in various ways within the scope of the invention.

In particular, the driver portion 19 formed in the plate portion 16 of the sliding member 15 may be of a slot type in place of the Phillips type.

According to the present invention, as is clear from the explanation above, the driver plate of the sliding member is formed into substantially a cone in shape, in which cone the driver groove portion is formed, thus enabling the driver to be inserted in a sure and easy manner for adjusting the resistance value, reducing the working time when manually adjusted, doing without such attendant expensive devices as a CCD camera and the like in case of automatic adjustment, and capable of conducting adjustment with reliability.

What is claimed is:

1. A variable resistor, comprising:

a substrate;

a curved resistor disposed on said substrate having a central point and resistor electrodes;

a sliding member rotatably connected with said substrate for rotation about the central point of said curved resistor, said sliding member being stamped from a thin sheet of conductive material and including a driver plate having a central projected portion and a substantially ring-shaped arm portion having a contact portion for contacting said curved resistor, said driver plate further having a substantially conical portion with a driver groove therein for rotation of said sliding member by a driver, and said sliding member further being formed by bending said thin sheet of conductive material over itself 180° such that said driver plate is bent over said arm portion; and a collector terminal connected to said sliding member.

2. The variable resistor of claim 1, wherein said substantially conical portion has an outer diameter larger than the outer diameter of said arm portion.

3. The variable resistor of claim 1, wherein said substantially conical portion of said driver plate has a flat portion at its outer periphery.

4. The variable resistor of claim 1, wherein said sliding member is one piece.

5. The variable resistor of claim 4, wherein said central projected portion of said driver plate of said sliding member contacts said substrate for rotation thereon.

6. The variable resistor of claim 5, wherein said driver groove in said conical portion is in an upper layer of two layers of said one-piece sliding member.

* * * * *